US008181662B2

(12) United States Patent
Pollack et al.

(10) Patent No.: US 8,181,662 B2
(45) Date of Patent: May 22, 2012

(54) HYDROCARBON TRANSFER SYSTEM WITH VERTICAL ROTATION AXIS

(75) Inventors: Jack Pollack, Houston, TX (US); Philippe Albert Christian Menardo, Nice (FR); Eric Barrabino, Monte-Carlo (FR)

(73) Assignee: Single Buoy Moorings Inc., Marly (CH)

( * ) Notice: Subject to any disclaimer, the term of this patent is extended or adjusted under 35 U.S.C. 154(b) by 668 days.

(21) Appl. No.: 12/295,401

(22) PCT Filed: Mar. 29, 2007

(86) PCT No.: PCT/EP2007/053020

§ 371 (c)(1),
(2), (4) Date: Sep. 30, 2008

(87) PCT Pub. No.: WO2007/113203

PCT Pub. Date: Oct. 11, 2007

(65) Prior Publication Data

US 2009/0165874 A1 Jul. 2, 2009

(30) Foreign Application Priority Data

Mar. 30, 2006 (EP) ..... 06112027

(51) Int. Cl.
*B63B 27/24* (2006.01)

(52) U.S. Cl. ..... 137/15.08; 137/615; 141/387

(58) Field of Classification Search ..... 137/615, 137/15.08; 141/387; 441/5

See application file for complete search history.

(56) References Cited

U.S. PATENT DOCUMENTS

| | | | | |
|---|---|---|---|---|
| 3,085,593 | A | 4/1963 | Sorensen | |
| 3,249,121 | A | 5/1966 | Bily | |
| 3,434,491 | A | 3/1969 | Bily | |
| 4,987,925 | A * | 1/1991 | Vroonland | 137/615 |
| 7,147,022 | B2 * | 12/2006 | Le Devehat | 141/387 |
| 2004/0099336 | A1 | 5/2004 | Le Devehat | |

FOREIGN PATENT DOCUMENTS

| | | |
|---|---|---|
| EP | 1308384 | 5/2003 |
| EP | 1389580 | 2/2004 |
| WO | 9935031 | 7/1999 |
| WO | 02092422 | 11/2002 |
| WO | 2005105565 | 11/2005 |

OTHER PUBLICATIONS

International search report in corresponding PCT/EP2007/053020.

* cited by examiner

*Primary Examiner* — Kevin Lee
(74) *Attorney, Agent, or Firm* — Young & Thompson

(57) ABSTRACT

A hydrocarbon transfer system includes a first structure with a length direction and a transverse direction having a frame carrying a vertical arm with at its end a fluid connecting member for connecting to a second structure which is moored alongside the first structure. The connecting member includes a winch and first guiding elements for engaging with second guiding elements on the second structure by connecting a wire to the winch on one end an to the second structure on the other end, and a tension device for moving the vertical arm away from the second structure for tensioning the wire.teh

16 Claims, 4 Drawing Sheets

HYDROCARBON TRANSFER SYSTEM WITH VERTICAL ROTATION AXIS

BACKGROUND OF THE INVENTION

The invention relates to a hydrocarbon transfer system comprising a first structure with a length direction and a transverse direction having a frame carrying a fluid transfer duct with at its end a fluid connecting member for connecting to a second structure which is moored alongside the first structure. The first structure may be a quay, vessel or the like.

Such a hydrocarbon transfer system is known from WO 2005/105565 A1 which shows a first vessel for containing hydrocarbons and hydrocarbon transfer means which are connected to a tank on the first vessel. The hydrocarbon transfer means comprise a connecting member for connecting to a second vessel which is moored alongside the first vessel. The hydrocarbon transfer means comprise a frame for carrying the fluid transfer duct with a connecting member at one of its ends.

The known hydrocarbon transfer system has as a disadvantage that when the connecting member is connected to the second vessel, stress is created in the fluid transfer duct and/or the frame because of movement of the moored second vessel relative to the first vessel. These movements also occur when a vessel is moored alongside a static structure, like a quay. One of the types of movement of a moored second structure are surge movements in the length direction of the first structure alongside which the second structure is moored. The known transfer system compensates such surge movements by a vertical transfer duct part which is connected to the frame pivotable around an axis extending in the transverse direction. Because of the pivoting displacements of the vertical transfer duct part, also an additional up and down displacement of the connecting member relative to the first structure is created. This up and down movement of the connecting member creates stress in the fluid transfer duct and/or in the frame. Stress in the fluid transfer duct and/or the frame can cause leakage of the transferred materials. Because the hydrocarbon transfer system is used for transferring highly inflammable hydrocarbons, such as LNG, leakage is undesired from a safety perspective. Therefore, the stress in the fluid transfer duct and/or the frame of the hydrocarbon system must be brought to a minimum.

A further disadvantage of the known hydrocarbon transfer system is that because of the pivoting movement of the vertical transfer duct part around the axis extending in the transverse direction, large displacements of the moored second structure in the length direction can not be compensated.

In patent publication WO2005105565, in the name of the applicant, a LNG loading arm is shown consisting of a frame connected to the deck of the FSRU via supports which are hingable around an axis. Hydraulic cylinders control the inclination of the frame. A number of transverse arms are connected to the top of the frame, pivotable around axes extending in the length direction of the vessel. The transverse arms carry at their inboard end a counterweight and at their other end a vertical support arm. The vertical support arm can rotate around an axis extending in the length direction of the transverse arms. Hard piping attached to the tanks on the FSRU extends via swivels along the frame. A transverse pipe section extends along the transverse support arms and is attached to a vertical duct via two swivels. The coupling end of the vertical duct is attached to a manifold on the tanker. The vertical support arm is suspended from the end of the transverse arm to be hingable around the axis extending parallel to the arm in a hinge point and around an axis extending perpendicular to the plane of the drawing. FIG. 18 of this patent publication shows the in-line swivels and the out of plane swivels of the support frame (and hence of the transfer ducts) in a schematic way. The coupling end of the vertical duct comprises a pull in line winch and a pull in line for attaching to the manifold on the LNG carrier. Still, a final horizontal displacement of the coupling end is needed to make a fluid connection with the flanges on the LNG carrier. As the guiding system is already fixed, a special system is needs to make the horizontal connecting between the flanges.

This problem is partly solved by the loading arm system disclosed in patent publication EP1389580 in the name of Bluewater. It shows a LNG transfer arm in which a fluid transfer hose is lowered vertically towards the connection flanges of a receiver duct of a LNG carrier. A pull-in winch is provided at the coupling part at the end of the vertical part of the crane structure which is based on a FSRU. The final adjustment and connection takes place in a horizontal direction. Patent publication U.S Pat. No.3,249,121 shows a balanced vessel loading arm with a vertical pull in line and which needed a horizontal final adjustment during the connection procedure as well. It does not disclose a final guiding system. Another problem is that the cable is connected to a winch which is placed at the base of the loading arm and that the cable ideally needs to be guided though each articulation joint of the system. As this is not possible, a tensioned cable introduces moments in the pivot points of the loading arm.

Patent publication WO 02092422 shows in FIGS. 3a and 3b a vertical connecting structure for a LNG loading arm with a male guiding pin connected to a LNG carrier and a winch for a connection rope at the end of a LNG loading arm.

Patent publication WO0222491 shows a balanced LNG loading arm for horizontal connection in which a first constant tension cable is attached with one end to the coupling part of the loading arm and with the other end to a constant tension winch. A second cable from a haul-in winch on the loading arm connects the loading arm with the coupling part of the fluid ducts on the LNG carrier.

The above known systems for loading and unloading LNG are for harbor situations, were there are mild environmental conditions and the base of the transfer arm is static as it is placed on shore. Different guiding mechanisms are shown to bring the coupling part of a loading arm towards a coupling part of a manifold on a LNG carrier.

For offshore midship loading and offloading of LNG between two floating structures, for example a floating gas liquefaction plant and a LNG carrier or between a FSRU and a LNG carrier, the distance between the two floating structures is much larger than in a harbour environment, in order to be able to deal with the relative offset of the two floating structures due to the independent yaw, pitch and roll motions.

As mentioned, the known transfer arms are designed for a more static situation. Hence, just scaling up the known systems for this offshore environment is not realistic as they are already sensitive to dynamics; in an offshore situation the acceleration in motions of the arms of the systems would create large problems as due to the inertia of the arms and counterweight very large loads are introduced resulting in fatigue problems within the transfer system.

Hence, an offshore LNG transfer system is needed for the transfer of LNG between two floating structures, which are in an offshore side-by-side mooring configuration and which can deal with the large relative movements of the two floating structures in a harsh offshore environments.

SUMMARY OF THE INVENTION

The present invention has as an object to provide an improved hydrocarbon transfer system. Therefore the hydrocarbon transfer system comprises a first structure with a length direction and a transverse direction having a frame carrying a vertical arm with at its end a fluid connecting member for connecting to a second structure which is moored alongside the first structure, wherein the connecting member comprises a winch and first guiding means for engaging with second guiding means on the second structure by connecting a wire to the winch on one end an to the second structure on the other end, and a tension device for moving the vertical arm away from the second structure for tensioning the wire. Hereby accurate positioning of the connecting member is achieved without collision in off-shore environment.

The present invention has as a further object to provide a hydrocarbon transfer system in which surge movements and relative positional variations in the length direction can be accommodated without causing undue stress forces in the connecting member. Hereto, the hydrocarbon transfer system according the invention is characterised in that the frame is rotatable around a vertical axis. Hereby the moored second structure can move in the length direction of the first structure and this movement is compensated by rotation of the frame, without creating the additional up and down displacements of the connecting member relative to the first structure.

In an embodiment of the invention the rotatable frame comprises a support frame part extending upwardly from deck level of the first structure, a transverse arm or duct being connected to the rotatable frame and a vertical transfer duct part extending downwardly from the transverse arm or duct in a movable joint such as to be pivotable around a first axis extending substantially in the length direction. The first axis extends in the length direction when the transverse arm or duct is extending in the transverse direction. When the frame is rotated this will have an effect on the exact directions in which the first axis extends. The same occurs with all other axes of the hydrocarbon transfer system according to the invention extending in the transverse or length direction. The support frame part and the transverse arm provide a simple construction with which the connecting member can be easily positioned in a preferred position above the cooperating connecting member of the second structure. When the connecting member of the hydrocarbon transfer system according the invention is connected to the moored second structure and the second structure is moving in the length direction, the frame will rotate to compensate that movement. Because of that the transverse arm or duct will pivot around the vertical axis. Due to this pivoting movement of the transverse arm or duct, the connecting member will also be slightly displaced in the transverse direction. This can lead to a small amount of stress in the fluid transfer duct and/or the frame. Because the vertical transfer duct part is pivotable around the first axis, the movement of the connecting member in the transverse direction is compensated.

In an embodiment of the invention the vertical transfer duct part comprises a rigid arm which is connected to the transverse arm or duct via a swivel allowing rotation around an axis extending in the length direction. The rigid arm may comprise a first counter weight which is connected via a pivot element to an end of the rigid arm and located at or near the vertical axis. The first counter weight has a positive effect on the pivot properties of the vertical rigid arm. Positioning of the first counter weight in or near the vertical axis results in good rotation properties of the frame. Preferably the centre of gravity of the first counter weight is located substantially on the vertical axis.

In an embodiment of the invention the transverse arm or duct is pivotably connected to the rotatable frame and a second counter weight is connected at or near an end of the transverse arm or duct. The transverse arm or duct is pivotable around an axis extending substantially in the length direction. The second counter weight has a positive effect on the pivot properties of the vertical rigid arm.

In an embodiment of the invention the rigid arm comprises a first actuator for pivoting of the rigid arm and/or the transverse arm or duct comprises a second actuator for pivoting of the transverse arm or duct.

The frame may also be displaceable in the transverse direction for compensating movement of the moored second structure in the transverse direction.

BRIEF DESCRIPTION OF THE DRAWINGS

The invention will be discussed in detail with reference to the accompanying drawings, wherein.

DETAILED DESCRIPTION OF THE PREFERRED EMBODIMENTS

Figure 1:
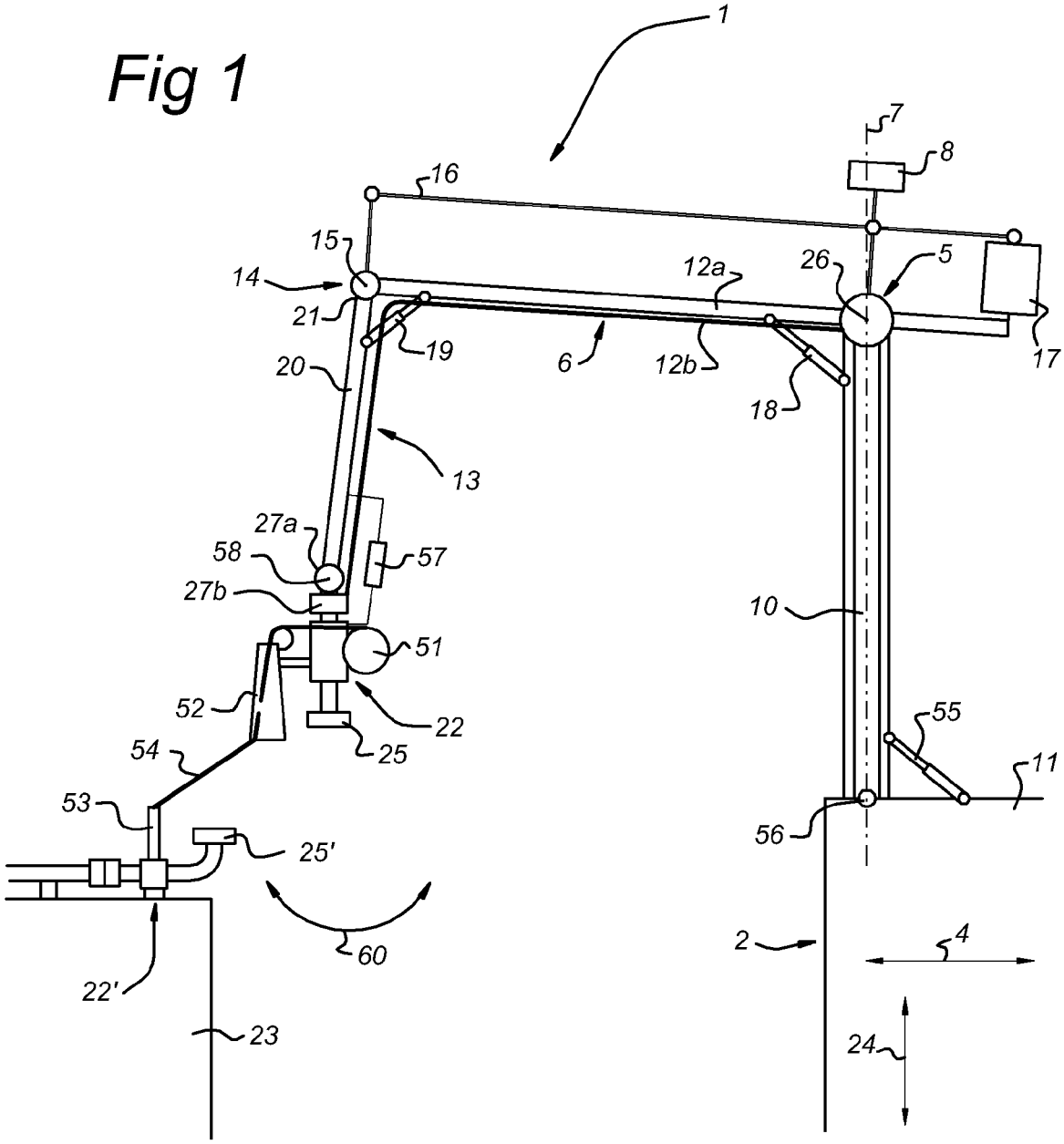
FIG. 1 schematically shows a side view of an embodiment of the hydrocarbon transfer system according the invention, and FIG. 2 schematically shows a plan view of the hydrocarbon transfer system of FIG. 1.

FIG. 1 shows an embodiment of the hydrocarbon transfer system 1 according the invention. The hydrocarbon transfer system 1 comprises a first structure 2 such as a sea-bed supported gravity based structure (GBS), quay, tower or a floating structure like a spread moored or weathervaning FSRU, a gas liquefaction plant or a floating power plant. The first structure 2 has a length direction perpendicular to the plan of the drawing (3 of FIG. 2), a transverse direction 4 and a height direction 24. The first structure 2 has a frame 5 which carries a fluid transfer duct 12*a*, 20. At its end the fluid transfer duct 12*a*, 20 has a connecting member 22 for connecting with a connecting part 25 to a cooperating connecting part 25' of the connecting member 22' of a second structure 23. The second structure 23 is moored alongside the first structure 2 and can be a shuttle tanker for transporting LNG. The frame 5 is rotatable around a vertical axis 7. The frame is supported by a colunmar support structure 10 which extends upwardly from the deck level 11 of the first structure 2. The vertical axis 7 extends through the longitudinal axis of the support structure 10 and perpendicular to a flat deck of the first structure 2. A transverse fluid transfer arm 12a is connected to the rotatable frame 5. At one end of the transverse arm 12*a*, a second counter weight 17 is connected. An actuator 18 is connected to the support frame part 10 and the transverse arm 12*a* for pivoting the transverse arm 12*a* actively around a second axis 26 extending in the length direction 3.

The umbilical 6 is guided via the fluid transfer arms 12*a* and 20 and is an hydraulic line to activate the valves and the quick connection-disconnection unit 22 from the first structure 2. The fluid transfer duct 12*a*, connects to a vertical fluid transfer arm 20 which extends in the height direction 24. The vertical fluid transfers arm 20 may be a flexible hose. The vertical arm 20 is connected to the transverse arm 12*a* via a movable joint 14 such as to be pivotable around a first axis 15 extending in the length direction 3. The movable joint comprises a swivel 21 for allowing rotation respectively around the first axis 15. A further actuator 19 is connected to the transverse arm 12*a* and the vertical arm 20 for pivoting the vertical arm 20 actively around a first axis 15 extending in the length direction 3. Both fluid transfer arms 12*a* and 20 can be reinforced by an additional rigid support structure (not shown) as for example is known from crane arms.

A first counter weight 8 is connected to one end of the vertical arm 20 by means of a pivot element 16. The counter weight 8 is located near the vertical axis 7.

For positioning of the connecting member 22 it comprises a swivel 27*a*, 27*b*) allowing rotation around an axis extending respectively in the length direction and an axis extending in the height direction.

The transfer system 1 may comprise a third actuator 55 for pivoting the frame 5, and especially the support structure 10, relative to the (deck of) the first structure 2 around an axis 56 extending in the length direction 3. In FIG. 1 the third actuator 55 is connected to the support structure 10 and (the deck of) the first structure 2.

The transfer system 1 comprises may comprise a fourth actuator 57 for pivoting the connecting member 22 relative to the second structure 23 around an axis 58 extending in the length direction 3. In FIG. 1 the fourth actuator 57 is connected to the vertical arm 20 and to the connecting member 22 to pivot the connecting member 22 in the direction of arrow 60.

The connecting member 22 comprises a winch 51 and first guiding means 52 for engaging with second guiding means 53 on the second structure 23 by connecting a pull-in wire 54 to the winch 51 on one end an to the second structure 23 on the other end. The transfer system further comprises a tension device 18, 19, 55 for moving the vertical arm 20 away from the second structure 23 for tensioning the wire 54. The tension device may comprise one of the actuators 18, 19, 55 or 57, a combination of two or three of the actuators 18, 19, 55 or 57, or all four of the actuators 18, 19, 55 and 57. Due to the tension device, an accurate positioning of the connecting member 22 relative to the connecting member 22' of the second structure 23 is achieved without collision in offshore environment.

Figure 2:
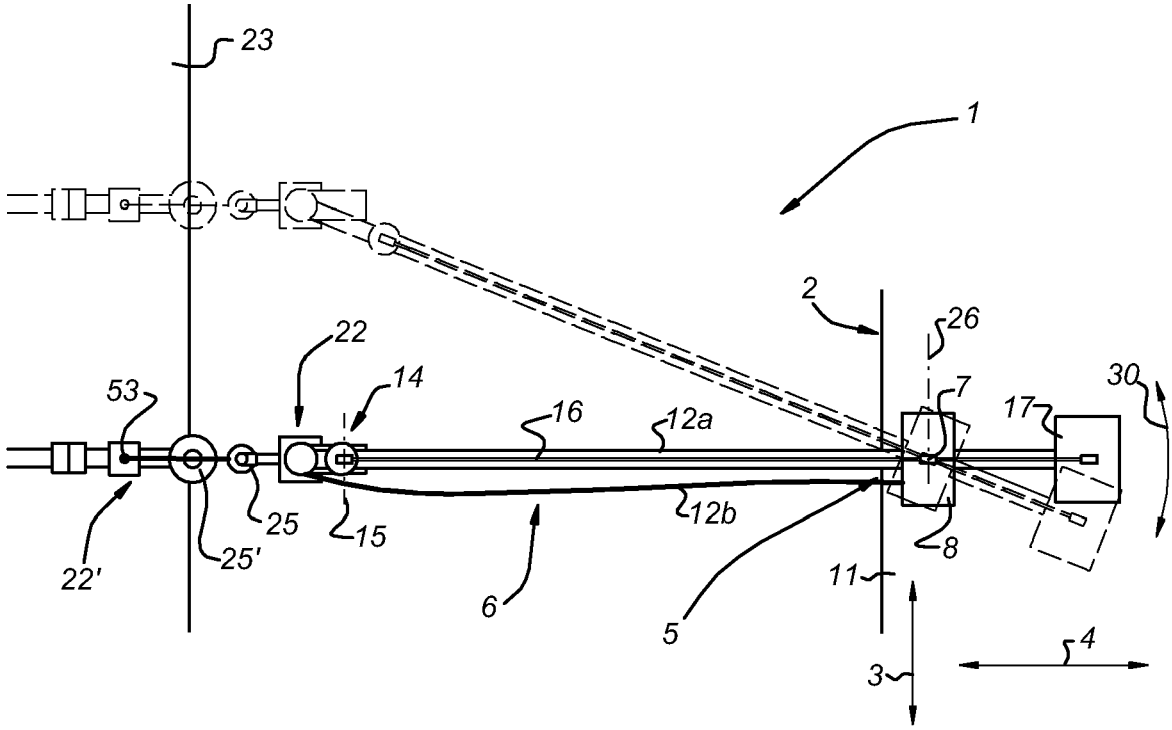

FIG. 2 shows a plan view of the hydrocarbon transfer system of FIG. 1. The parts of the hydrocarbon transfer system 1 shown with dotted lines show the position of the connecting member 22 when the frame 5 is rotated around the vertical axis 7 and as indicated by arrow 30. The vertical transfer duct part 13 is hereby pivoted around the first axis 15 to compensate the displacement of the connecting member 22 in the transverse direction, which displacement occurs due to the pivoting movement of the transverse arm 12 a around the vertical axis 7.

Figure 3:
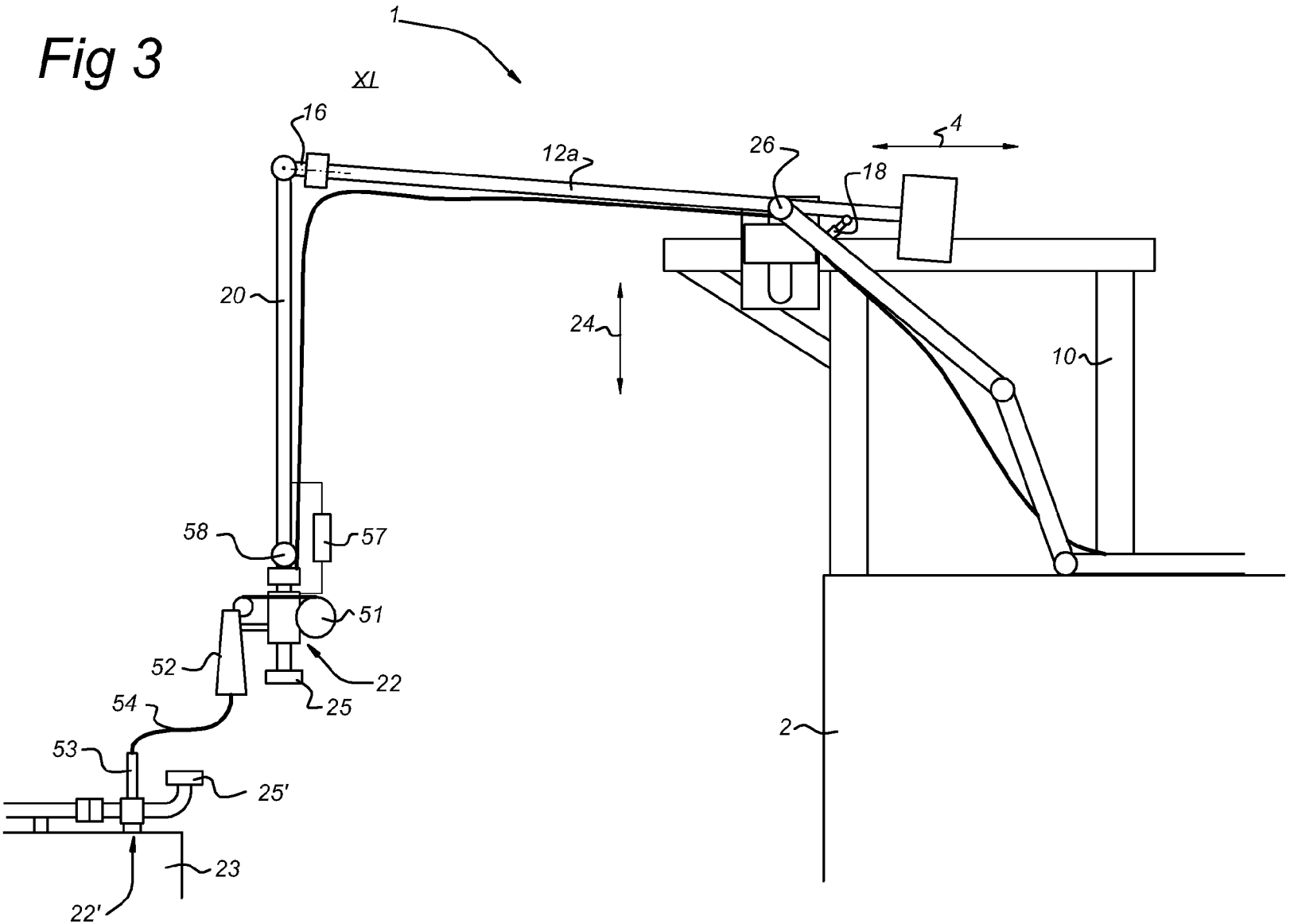
FIG. 3 schematically shows a side view of a further embodiment of the hydrocarbon transfer system according the invention, and FIG. 4 schematically shows a plan view of the hydrocarbon transfer system of FIG. 3.

FIG. 3 shows a side view of a transfer system according the invention. It shows an improved loading arm design of WO2005105565 in the name of the applicant. Depending on the design of the support frame which is placed on a Gas To Liquid (GTL) barge or the FSRU, the LNG transfer system which can consist of multiple LNG loading arms, is normally placed midships of the floating structure were the (pitch) motions are relatively small.

The gap between the offshore side-by-side moored floating structures can be as large as 30 m which needs to be bridged with this LNG transfer system. In FIG. 1 the first or horizontal arm can for example have a length of 17 m and is pivotably connected to a frame which is supported by the GTL barge or FSRU. The frame itself can for example extend 13 m outboard from the barge or FSRU. The horizontal arm can further be displaced inwardly and outwardly in a horizontal direction. When no LNG carrier is connected to the transfer system, the arms can be stored into a rest position were also repair and maintenance can be done.

In the transfer system design of FIG. 3, the second or vertical arm is pivotably connected to the horizontal arm around two axes. The fluid duct in the horizontal arm is provided with a roll swivel to allow the offset of the vertical fluid duct as is shown in the top view of FIG. 4 of the system.

The vertical arm can be LNG pipe combined with a support frame (not shown) and can have for example a length of around 14 m.

A pivoting force element 18 is provided between the upper end of the frame and the horizontal arm for controlling the position of the horizontal arm and to block it for example in a rest position. The force element is needed to adjust the tension in the pull-in line during the connection procedure, for example to avoid clashes of the two coupling part flanges. It can also be adjusted during the loading process to compensate for the weight of ice building up on the arms and the coupling. The force element furthermore compensates for the change in weight of the first coupling part when during an emergency disconnection a quick disconnection between two quick disconnectable flanges is made (which are not the two normal connection flanges) so that a part of the first coupling stays connected to the LNG carrier. The pivoting force element can be a hydraulically driven piston mechanism or a motor.

At the lower end of the vertical or second arm, the first coupling part is attached which can pivot around three axis. Hence, the fluid transfer system needs to be able to pivot around axes as well, which can be realized by hard piping with three swivels (roll, pitch and yaw swivels), by a ball type swivel or by a flexible hose (part). The first coupling part is provided with a fluid pipe flange 25 which is in a horizontal plane and which can be vertically aligned with and coupled to a receiving horizontally placed second flange 25' of a second coupling part, which is connected to the midship manifold piping of the LNG carrier. This second coupling part can be an elbow type of pipe section which is connected to the standard midship manifold and which is supported directly by the LNG carrier.

To guide the two coupling parts correctly towards each other in the harsh offshore environment, both coupling parts are provided with guiding means which cooperate with each other and which ensure a final alignment of the first and second flanges when the second arm is lowered vertically. The first coupling part is therefore provided with a first downwardly orientated female guide means which can receive the second, upwardly orientated male guide means which is placed near the second coupling part on the LNG carrier. The male and female guide means can be placed on either coupling part. The male guide means is be connected to the 90 degree elbow section which has the second, horizontal placed flange 25' attached to it and is directly supported on the LNG carrier to be able to transfer forces and moments away from the flanges.

This guiding arrangement makes it possible that when lowering the second arm towards the vessel during the connection procedure, the final adjustment and connection between the first and second flanges is made also in a vertical direction.

Figure 4:
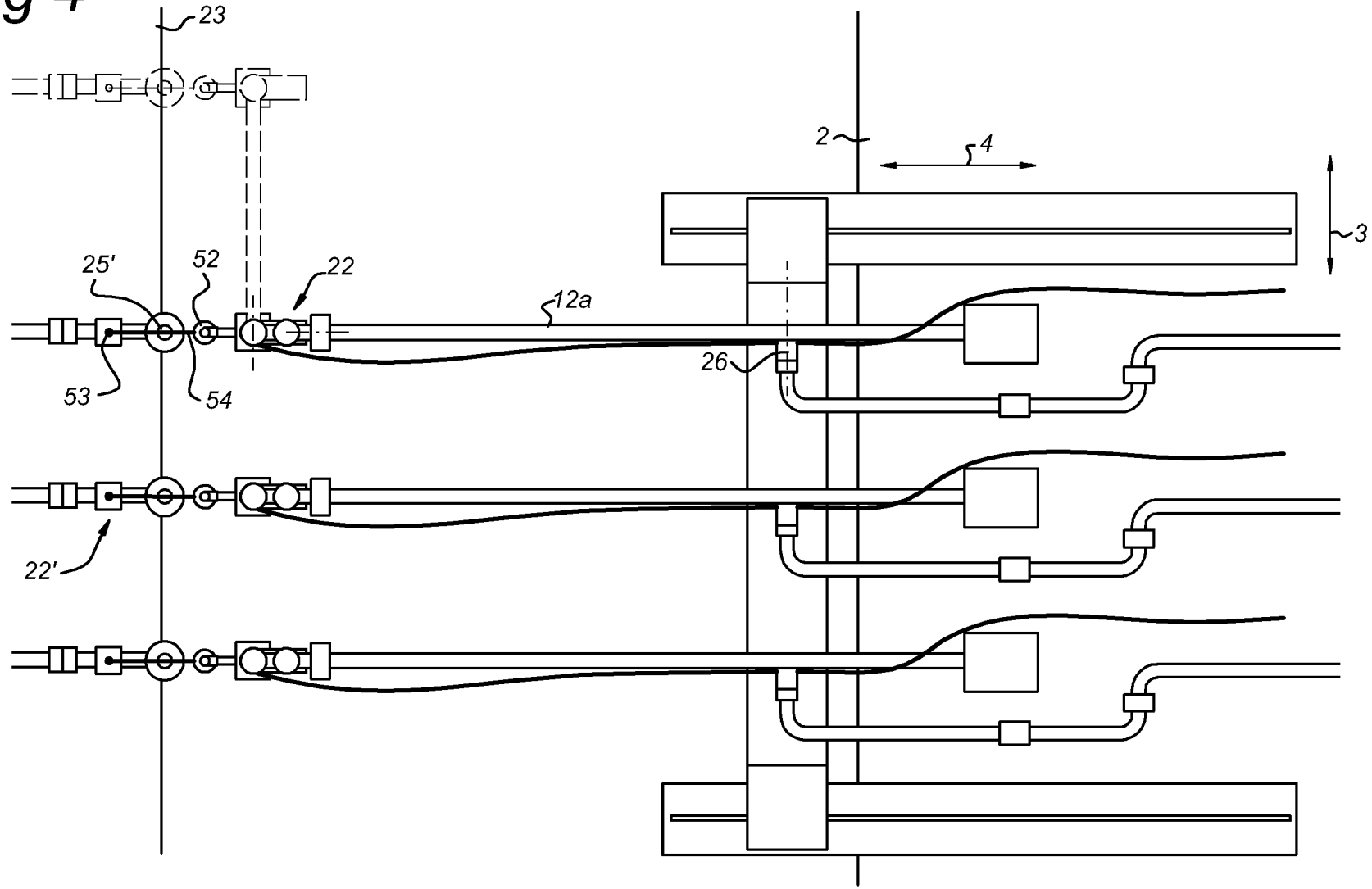

The first coupling part is furthermore provided with a pull-in winch for a pull-in line. The winch is placed on the first coupling part below the pivot point such that it balances out the first guide means, so that the first coupling part is hanging in a horizontal plane. The first coupling part is provided with hydraulics, for example for opening and closing of valves and the quick-disconnection system. The hydraulics are also used for manipulating the orientation of the first coupling part during connection process so that it is always more or less perpendicular to the longitudinal axis of the vessel; this ensures an alignment of the first and second guide means and the first and second flanges. The hydraulic system for manipulating the orientation of the first coupling part can be a passive system which is driven via a hydraulic line by the offset of the first or second arm, as is shown in FIGS. 2 and 4.

To further reduce and limit during loading/offloading of the LNG the forces and (heave) moments which are acting on the flanges and to compensate for the large relative draft variations of the two floating structures, the system is provided with a vertical draft compensation means between the frame and the horizontal arm. The displacement of the horizontal arm in a vertical direction makes it possible to limit the inclination of the horizontal arm during the LNG transfer process within a range of +/−10 with the horizontal.

FIG. 1 shows another concept of a counter-balanced NLG loading arm, also provided with a more or less horizontal first arm and a more or less vertical second arm during connection and transfer mode. As this loading arm can rotate around a vertical axis through the support frame, no horizontal swivel is needed in the horizontal arm. The vertical arm is connected to the horizontal arm and can pivot around one axis in this connection point. Again, the first coupling member can during the connection process be orientated such that it is always in line with the second coupling part on the LNG carrier. The orientation can be done hydraulically and can be even passively driven by using the offset of the horizontal arm, as is shown in FIG. 2.

The following steps are taken during the connection procedure. After the LNG carrier is moored side-by-side to the GTL barge or FSRU, the transfer system is moved from its rest position into pre-offloading position. The horizontal first arm is placed outwardly and the second arm is brought into a vertical position. Then the first coupling part is positioned such that it extends transversely to the longitudinal axis of the LNG carrier and in line with the second coupling part on the carrier. The first coupling part is less than 5 m above the second coupling of the LNG carrier and within a horizontal offset of the two flanges of less than 3 m. The pull-in line is paid out by the pull-in winch and picked up by a person on the LNG carrier and connected to the upwardly orientated second guide means aboard the carrier. The pivoting force element is activated and applies a counterforce when the pull-in line is pulled in by the pull-in winch such that the pull in line in tensioned. The vertical arm is further lowered by pulling in the pull-in line so that the first and second flanges are aligned with the aid of the first and second guide means. Due to the orientation of the guide means the final alignment is also vertically when the pull-in line is pulled in. The guide means ensures a correct alignment of the two flanges, so that the first flange is brought correctly into contact with the second flange. After a connection is made between the two horizontal flanges, a fluid tight connection is secured by a hydraulic activated clamping mechanism. After security checks, the LNG can be transferred to or from the LNG carrier though the transfer system according the invention (which can include up to 5 loading arms or more). During LNG transfer, the pivoting force element can be adjusted to compensate for the weight of the ice which is building up on the loading arms. Also, due to the relative changes in the horizontal draft of the vessels resulting from the transfer of LNG from one vessel to the other, the horizontal arm or a part of the frame which supports multiple horizontal arms, can be displaced in the vertical direction.

For disconnecting the LNG carrier from the LNG transfer system the reverse procedure as described above has to be followed.

The invention claimed is:

1. A hydrocarbon transfer system, comprising:

a first structure with a first direction and a transverse direction, the first structure having a frame carrying a vertical arm and a fluid connecting member at an end of the vertical arm for connection with a second structure moored alongside the first structure, wherein the connecting member comprises a winch and first guiding means for engaging with a second guiding means on the second structure via a wire connected to the winch at a first end of the wire and to the second structure at a second end of the wire, and a tension device for moving the vertical arm away from the second structure for tensioning the wire, wherein the frame is rotatable around a vertical axis, and comprises a rotatable support frame part extending upwardly from a deck level of the first structure, wherein the rotatable frame part has a transverse arm connected thereto, the transverse arm including a transverse fluid transfer duct, and a secondary arm extending downwardly from a movable joint on the transverse arm so that the secondary arm is pivotable about a first axis extending substantially in the first direction, the secondary arm including a secondary fluid duct, wherein the transverse arm is pivotably connected to the rotatable frame to pivot about a second axis through the rotatable frame, and a counterweight is connected at an end of the transverse arm, and wherein the secondary arm comprises a first actuator to pivot the vertical arm about the first axis, and the transverse arm comprises a second actuator to pivot the transverse arm about the second axis.

2. The hydrocarbon transfer system according to claim 1, wherein the secondary arm comprises a rigid arm connected to the transverse arm via a swivel.

3. The hydrocarbon transfer system according to claim 2, wherein the rigid arm comprises a secondary counter weight connected via a pivot element to an end of the rigid arm and located proximate to the vertical axis.

4. The hydrocarbon transfer system according to claim 1, wherein the secondary arm comprises a flexible hose.

5. An apparatus for connecting a fluid transfer duct to a floating vessel, comprising:

a base part extending upwardly from a first structure;

a first substantially horizontal arm with a counterbalance system, the first arm being pivotably connected to an upper end of the base part;

a second substantially vertical arm supported by the first arm;

a pivoting force element between the upper end of the base part and the first arm for controlling an inclination of the first arm relative to the base part; and a first coupling part which is pivotably connected to a lower end of the second arm so that the first coupling part can pivot around three axes, the first coupling part having a horizontally placed first flange for making a vertical fluid connection with a horizontally placed second flange of a second coupling part fixed on a vessel for the transfer of fluids, the first coupling part further provided with a pull-in line winch for a pull-in line, and a first downwardly orientated guide means configured to cooperate with a second upwardly orientated guide means proximate to the second coupling part such that when the second arm is lowered towards the vessel during a connection procedure, the final displacement between the first and second flange is in a vertical direction.

6. The apparatus according to claim 5, wherein the apparatus comprises hydraulic control lines along the arms to control a heading of the first coupling part.

7. The apparatus according to claim 5, wherein the first guide means and the pull-in winch are placed on opposite sides of a vertical axis of the first coupling part such that the first coupling part is balanced in a horizontal plane.

8. The apparatus according to claim 5, wherein the first arm is placed plus or minus 10 degrees from the horizontal, and the second arm is plus or minus 10 degrees from the vertical during connection of the first coupling part with the second coupling part.

9. The apparatus according to claim 5, further comprising:

a system for manipulating an orientation of the first coupling part during connection of the first coupling part with the second coupling part so that the first coupling part is always more or less perpendicular to the longitudinal axis of the vessel to align the first and second guide means and the first and second flanges.

10. The apparatus according to claim 9, wherein said manipulating system comprises a hydraulic system.

11. The apparatus according to claim 10, wherein the system for manipulating the orientation of the first coupling part consists of a hydraulic system which is driven by an offset of the first or second arm.

12. The apparatus according to claim 5, further comprising:

a pivoting force element that is re-adjustable for an additional weight of ice building up on the first and second arm during transfer of LNG.

13. The apparatus according to claim 5, wherein the first arm is displaceable relative to the base part in a direction transverse to the vessel.

14. The apparatus according to claim 5, wherein the first structure is an offshore placed floating unit moored to the seabed.

15. The apparatus according to claim 6, wherein the first guide means and the pull-in winch are placed on opposite sides of the vertical axis of the first coupling part so that the first coupling part is balanced in a horizontal plane.

16. A method of connecting a fluid transfer apparatus to a vessel, the apparatus comprised of a base part extending upwardly from a first structure, a first arm with a counterbalance system, the first arm being pivotally connected to an upper end of the base part, a second arm pivotally supported by the first arm, a pivoting force element between the upper end of the base part and the first arm for controlling an inclination of the first arm relative to the base part, a first coupling part pivotally connected to a lower end of the second arm so that the first coupling part can pivot about three axes, the first coupling part having a horizontally placed first flange for making a fluid connection with a horizontally placed second flange of a second coupling part fixed on a vessel for the transfer of fluids, the first coupling part further provided with a pull-in line winch for a pull-in line and a first downwardly orientated guide means configured to cooperate with a second upward orientated guide means proximate to the second coupling part, the method comprising the steps of:

connecting the pull-in line to the second guide means and tensioning said line with the aid of the winch;

generating a small upward tension force in the second arm with the aid of the pivoting force element;

lowering the second arm by pulling in the pull-in line via the winch;

vertically aligning the first and second flanges with the aid of the first and second guide means while pulling in the pull-in line; and lowering in a vertical direction the first flange onto the second flange and securing a fluid tight connection between the two horizontal flanges.

* * * * *